US005620135A

United States Patent [19]

Stahlecker et al.

[11] Patent Number: 5,620,135

[45] Date of Patent: Apr. 15, 1997

[54] CONTAINER

[75] Inventors: Werner Stahlecker, Stuttgart; Berthold Mueller, Suessen, both of Germany

[73] Assignee: Ruediger Haaga GmbH, Altoberndorf, Germany

[21] Appl. No.: 418,798

[22] Filed: Apr. 7, 1995

[30] Foreign Application Priority Data

Apr. 7, 1994 [DE] Germany ..... 44 11 924.0

[51] Int. Cl.[6] ..... B65D 3/28

[52] U.S. Cl. ..... 229/198.2; 229/4.5; 229/123.3; 229/125.15; 229/198.3

[58] Field of Search ..... 229/31, 4.5, 123.3, 229/125.04, 125.14, 125.15, 198.1, 198.2, 198.3; 220/642, 644, 680

[56] References Cited

U.S. PATENT DOCUMENTS

| | | | |
|---|---|---|---|
| 492,806 | 3/1893 | Hunter | 229/198.3 |
| 533,744 | 2/1895 | Preater | 229/198.3 |
| 2,113,824 | 4/1938 | Bresee, Jr. | 229/198.3 |
| 2,347,686 | 5/1944 | Hothersall | 229/125.14 |
| 2,623,444 | 12/1952 | Maier et al. | 229/198.2 |
| 2,795,366 | 6/1957 | Magill | 229/198.3 |
| 3,070,274 | 12/1962 | Elam | 229/198.2 |
| 3,101,879 | 8/1963 | Meyer-Jagenberg | 229/123.3 |
| 3,157,337 | 11/1964 | Elam . | |
| 3,279,675 | 10/1966 | Elam et al. | 229/4.5 |
| 3,348,756 | 10/1967 | Boysen . | |
| 3,412,919 | 11/1968 | Cain | 229/125.14 |
| 3,816,206 | 6/1974 | Coster | 229/4.5 |
| 3,819,085 | 6/1974 | Rohowetz | 220/680 |
| 4,858,782 | 8/1989 | Yasumuro et al. | 220/680 |
| 5,203,492 | 4/1993 | Schellenberg | 229/4.5 |

FOREIGN PATENT DOCUMENTS

3023835A1 1/1981 Germany .

*Primary Examiner*—Gary E. Elkins

*Attorney, Agent, or Firm*—Evenson, McKeown, Edwards & Lenahan, P.L.L.C.

[57] ABSTRACT

A container is formed from at least one sheet-shaped segment made of paper and the like. The edges of the container which come into contact with the contents of the container are provided with a protective covering covering the surfaces bordering those edges of the segment as well as those of the wall of the container formed by the segment. The area of the segment to be covered by the protective covering is less thick, so that the thickness of the segment including the protective covering remains constant overall. The area with a reduced thickness is made by compressing the material of the segment. A segment provided with a protective covering and having a constant thickness can thereby be produced simply and cost-effectively.

21 Claims, 8 Drawing Sheets

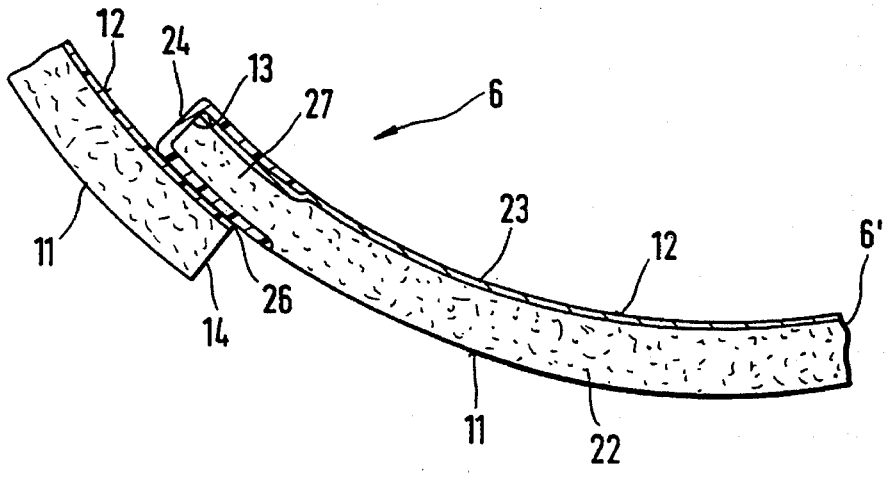
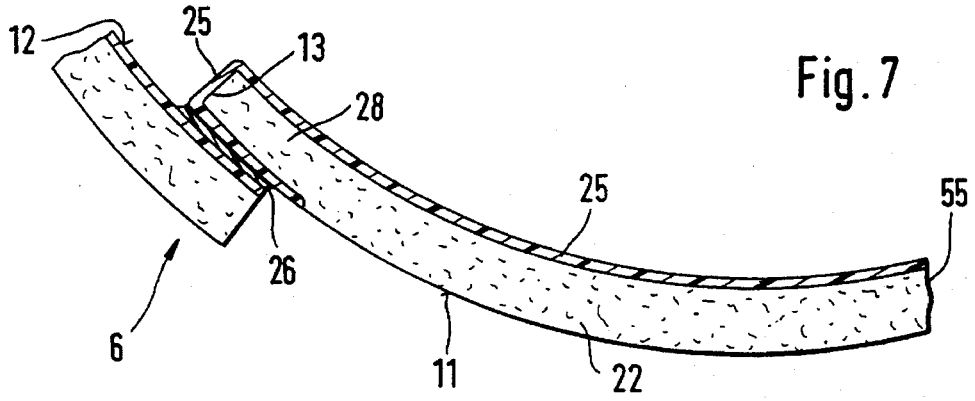
Fig. 7
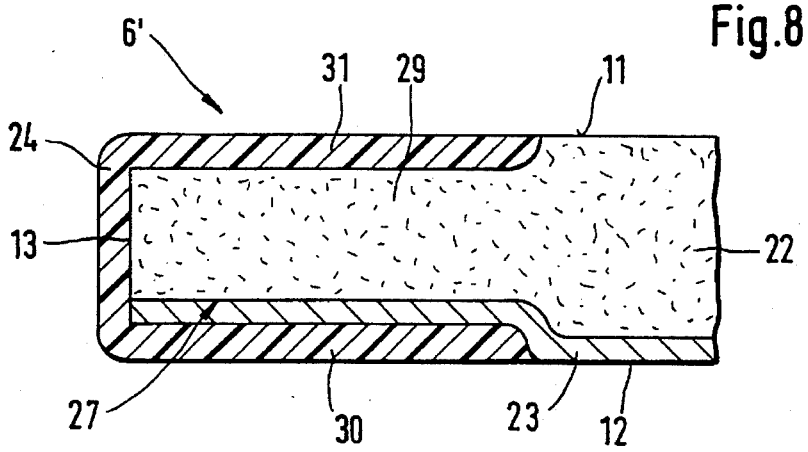
Fig. 8

CONTAINER

CROSS-REFERENCE TO RELATED APPLICATION

This application is related to application Ser. No. 08/418,801 filed on Apr. 7, 1995 in the name of Werner Stahlecker and Berthold Mueller for A PROCESS FOR COVERING CUT EDGE OF A CONTAINER OPENING WITH PROTECTIVE LAYER.

BACKGROUND AND SUMMARY OF THE INVENTION

The present invention relates to a container with at least one wall element which is made of one or more sheet-like segments having at least one edge enclosed by a protective covering which covers the inner surface and the outer surface of the area bordering the edge. The area has such a reduced thickness that the segment including the protective covering has at least an almost constant thickness.

German published patent application 3023835 describes a container which is made up of a plurality of wall elements. Each wall element comprises a paper carrier layer covered by at least one protective layer which is directed towards the inside of the container after assembly thereof. During production of the container, a segment is formed into an essentially conical body portion. An end area of the segment with an edge projects thereby into the inside of the container.

The edge projecting into the inside of the container is surrounded by a protective covering. The protective layer of the segment serves as a protective covering, which is folded over at an angle of 180° in the area of the edge so that the edge itself, and the area of the segment joined thereto are surrounded by the protective covering.

First, for the production and application of the known protective covering, the carrier layer of the segment in the end area comprising the edge is skived, so that the segment there possesses essentially only half material size. A longitudinal groove is then formed at the bisecting line of the skived area and an adhesive is applied to the skived area. Finally, the skived area is folded over at an angle of 180° along the longitudinal groove and adhered together. This process makes a protective covering in the area of the edge, and the covering is formed by the folded protective layer of the segment to cover the edge itself as well as the two sides of the segment resting on each other and joined to the edge.

Due to the paring down of the material at the longitudinal end to half its thickness, and the subsequent folding together of the end strip, a thickness is maintained in the area of the edge which corresponds overall at least approximately to the thickness of the segment. The segment, including the protective covering, has an overall, at least approximately, constant thickness. The purpose of the skiving of the material at the end area of the segment is to avoid cracks forming during folding, which cracks can occur in the case of full-strength material.

An object of the present invention is to provide in a container an edge protection which is simple and cost-effective to produce without having to increase a segment thickness.

This object has been achieved in accordance with the present invention by compressing the area to be covered by the protective covering.

The container and process therefor according to the present invention has the advantage that the reduction of the thickness of the segment in the area to be covered by the protective covering can be carried out in a particularly simple and cost-effective way. After application of the protective covering onto the area with a reduced thickness, the segment that is used for producing the container has an overall, at least approximately constant, thickness.

The approximately constant thickness makes possible a simplified production of the container. Segments of constant thickness are particularly good for stacking in piles to feed to container manufacturing machines. Also a plurality of segments can be put together to form a cardboard tape which can be presented in rolled-up form to a container manufacturing machine.

The present invention can be applied usefully to all containers where it is to be avoided that a medium, in particular the liquid contents, leaks into the wall elements of the container. In the edge area, the surface of the segment which is to be made into a wall element of the container is frequently broken open, particularly when the edge is made by cutting or punching. By applying the protective covering, the same or a similar protection can be made in the edge area as exist in the other areas of the container regardless of the outer shape of the container.

Another advantageous aspect of the present invention involves a segment which comprises a carrier layer and a protective layer. The thickness in the edge area is reduced in that the protective layer and/or the carrier layer is compressed. The protective covering can itself be compressed advantageously in the area of the segment to be covered.

In one advantageous embodiment of the present invention the protective covering is made in one with the protective layer of the segment.

Moreover, the present invention can be applied to all edges of a container to be covered with a protective covering.

In an advantageous embodiment of the present invention, a segment is made into a wall and forms a side body element of the container. Consequently, a section of the segment is so arranged that it overlaps the inner surface of the wall and is fastened thereagainst to project into the inside of the side body element. The end of the section is formed by an edge which is covered with a protective covering.

According to another advantageous aspect of the present invention, the edge to be covered is provided at an opening which is set in a container wall. This opening can be advantageously covered by a pull tab, whereby the area of the segment which can be covered by the pull tab also has a reduced thickness. The segment is then essentially of constant thickness in the area covered by the protective covering as well as in the area covered by the pull tab.

Compression of the segment is advantageously carried out by applying mechanical pressure to the area to be compressed.

BRIEF DESCRIPTION OF THE DRAWINGS

These and further objects, features and advantages of the present invention will become more readily apparent from the following detailed description thereof when taken in conjunction with the accompanying drawings wherein:

FIG. 6 is an enlarged, partial cross-sectional view of the container body in FIG. 2 with a first embodiment of a protective covering;

FIG. 7 is an enlarged, partial cross-sectional view of the container body in FIG. 2 similar to FIG. 6 but with a second embodiment of a protective covering;

FIG. 8 is an enlarged, partial cross-sectional view of a segment for a container body along the line VIII—VIII in FIG. 5;

DETAILED DESCRIPTION OF THE DRAWINGS

Figure 1:
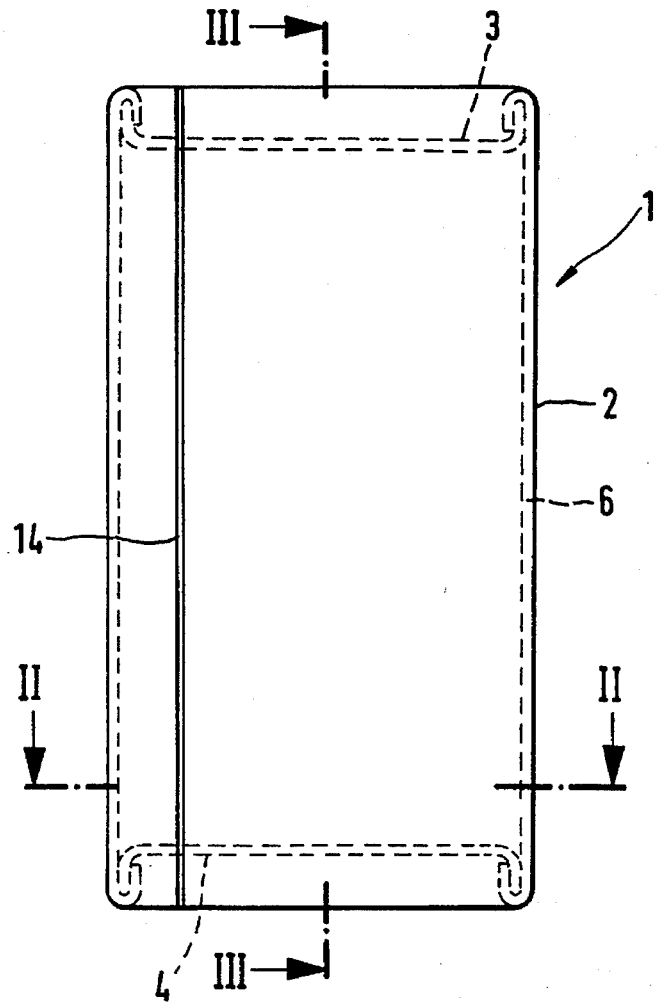
FIG. 1 is an elevational or longitudinal view of a cylindrical container with a container body, a bottom and a lid in accordance with the present invention.
Figure 3:
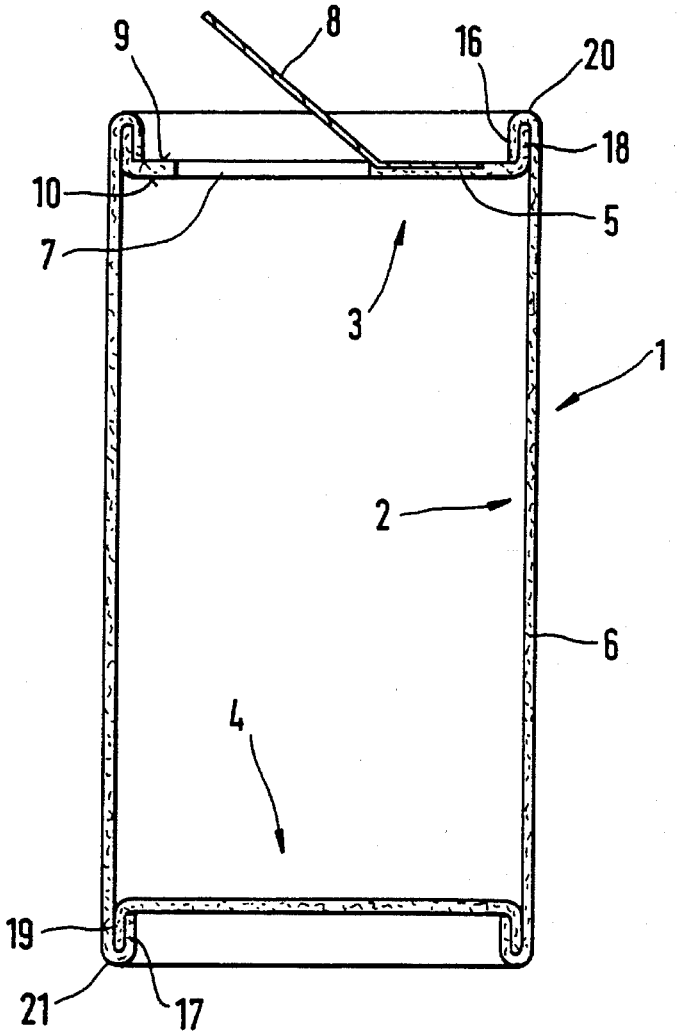
FIG. 3 is a longitudinal cross-sectional view through the container along the line III—III of FIG. 1.

The container 1 shown in FIGS. 1 and 3 is configured as a can which comprises a cylindrical container body 2, a circular or round-shaped bottom 4 and a circular or round-shaped lid 3. The lid 3 is provided with an opening 7, which can be closed by a pull tab 8. The pull tab 8 is shown pulled back from the opening 7 in FIG. 3 position. The wall 5 of the lid 3, the wall of the bottom 4 and the wall 6 of the container body 2 are connected together in a non-detachable way and form together a continuous wall of the container 1.

Figure 2:
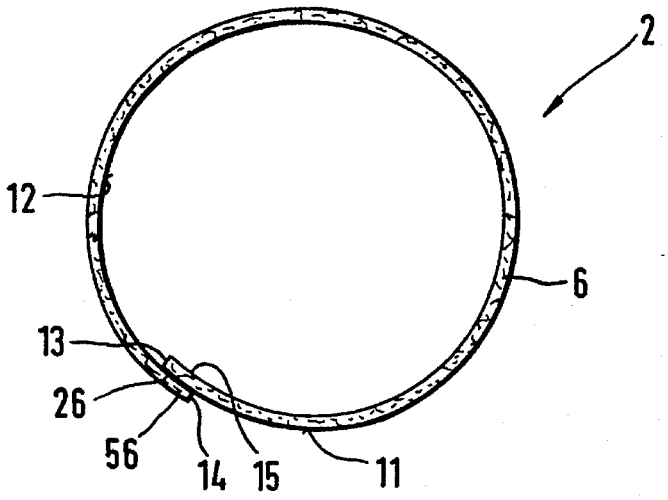
FIG. 2 is a cross sectional view through the wall of the container body along the line II—II of FIG. 1.

As can be seen in particular in FIG. 2, the container body 2 of the container 1 is formed by a wall 6 extending essentially ring-shaped in cross section. The wall 6 is made from a sheet-like segment 6' seen in FIG. 5. In order to make the ring-shaped form of the wall 6 as shown in FIG. 2, the rectangular, sheet-like segment 6' is rolled over a conventional cylindrical forming mandrel (not shown) in a generally known manner. The end portions 15' and 56' of the segment 6' are caused to overlap each other, so that two overlapping sections 15, 56 are formed at the wall 6.

The edge 13 of the overlapping section 15 is projected inside the container body 2 and the edge 14 of the overlapping section 56 is projected outside of the container body 2. The overlapping sections 15, 56 of the end portions of the segment 6' formed into the wall are put against each other and are attached to each other, preferably by heat sealing, at the sealing area 26. The wall 6 now has a tube shape and extends ring-shaped, as viewed in cross section, as can be seen in FIG. 2. This ring-shaped form does not change during the rest of the manufacturing process. The side view in FIG. 17 shows the present stage in production of the tube-shaped wall 6, i.e. the stage of production just described with reference to FIGS. 1, 2 and 5.

Figure 5:
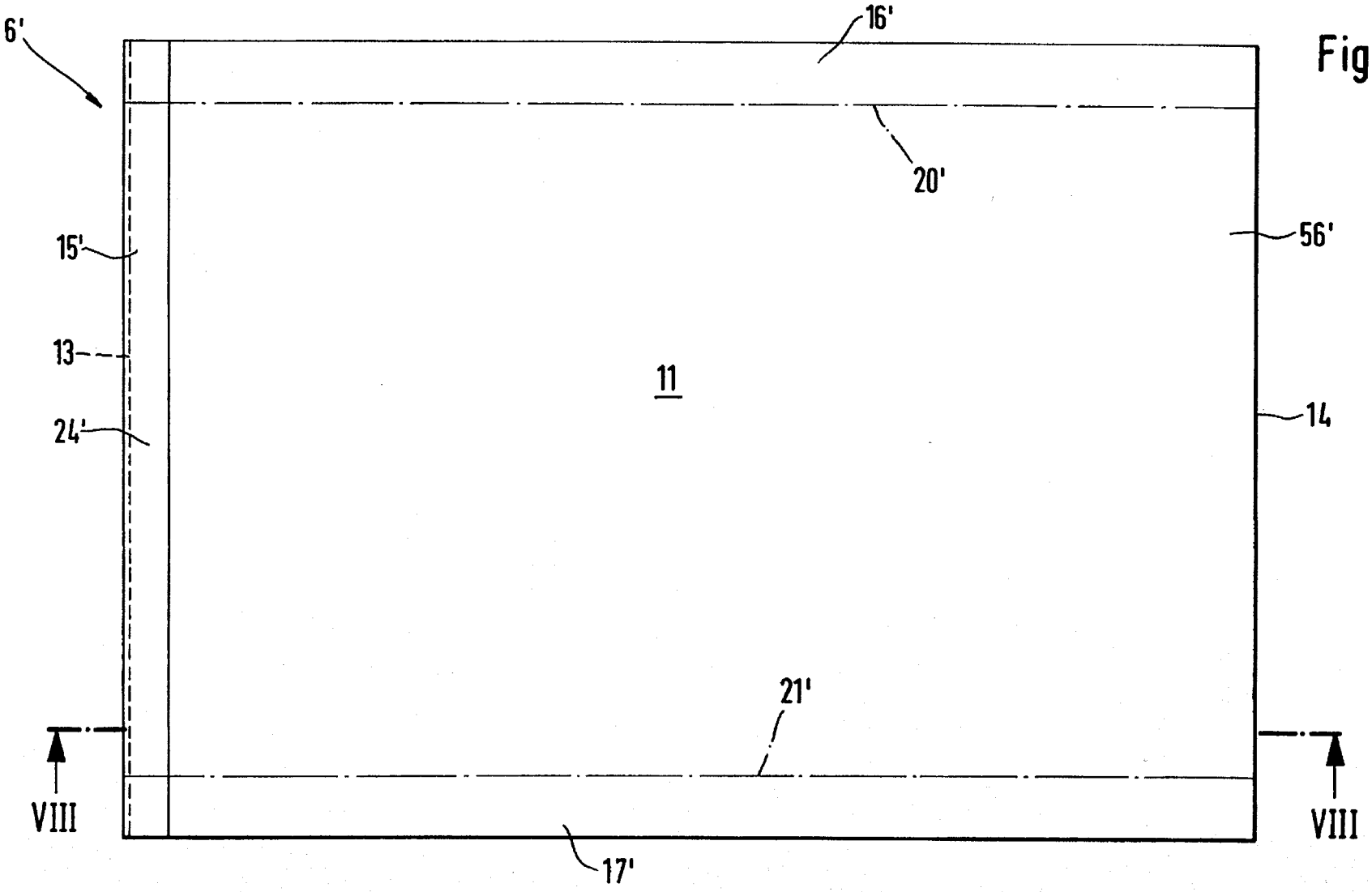
FIG. 5 is a projection of a segment into plan view for making the body of the container in FIG. 1.

As can be further seen in FIG. 5, border areas 16',17' are provided in the unformed segment 6' and can be folded along respective folding edges 20', 21'. In the production stage of the wall 6 shown in FIG. 17, the border areas 16, 17 form the two front ends of the tube-shaped wall 6. The folding over of the border areas 16, 17 will be carried out in a manufacturing phase to be described below.

Figure 12:
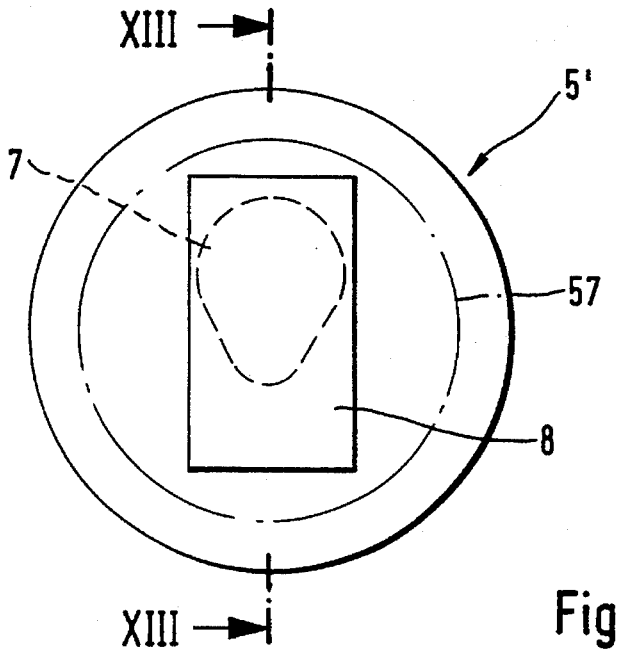
FIG. 12 is a segment for making the lid of the container in FIG. 1.
Figure 13:
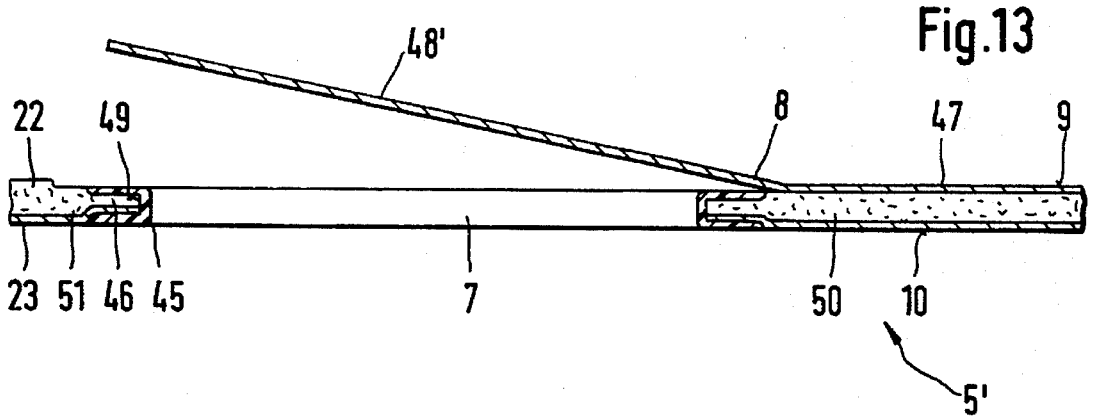
FIG. 13 is an enlarged partial cross-sectional view of the segment in FIG. 12 with open pull tab along the line XIII—XIII in FIG. 12.
Figure 14:
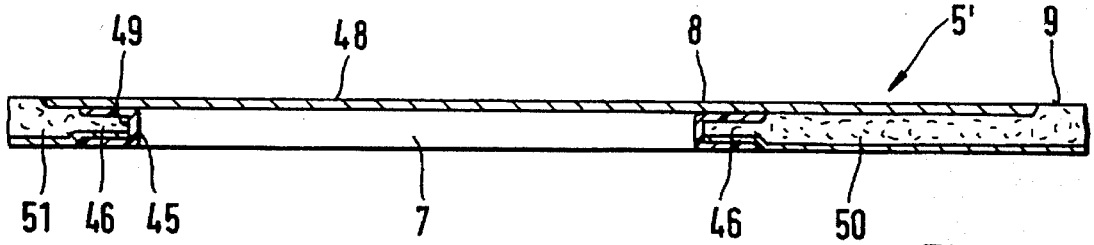
FIG. 14 is an enlarged partial cross-sectional view of the segment in FIG. 12 similar to FIG. 13 but with a closed pull tab.

The lid 3 and the bottom 4 are each formed from a sheet-like segment, whereby only the segment 5' for the lid 3 is shown in FIGS. 12, 13 and 14. The ring-shaped, sheet-like segments 5' are formed along the folding edge 57 such that a projecting rim 18 (see also FIG. 4) is formed at the lid 3 and a projecting rim 19 is formed at the bottom 4.

Figure 17:
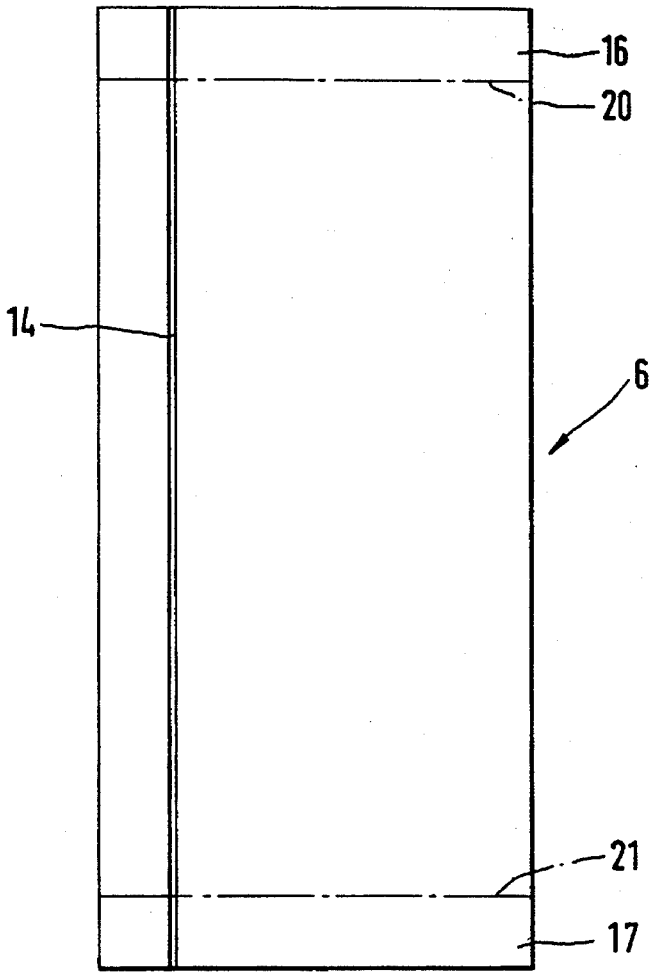
FIG. 17 is a longitudinal view of a wall of the container body of the container in FIG. 1 in an intermediate stage of production.

For assembling the container 1, the bottom 4 and the lid 3 are brought into the inside of the tube-shaped wall 6, shown in FIG. 17, so that the projecting rims 18, 19 are each directed towards the outside, i.e. away from the wall 6 in the longitudinal direction. The border area 16 of the container body 2 is folded along the folding edge 20 over the projecting rim 18 of the lid 3, and the border area 17 of the container body 2 is folded along the folding edge 21 over the projecting rim 19 of the bottom 4, so that the shape of the container 1 as shown in FIGS. 1 and 3 is attained.

In the above-described front end areas in which the border areas 16, 17 of the container body 2 are folded over, the lid 3 and the bottom 4 are attached to the container body 2 by pressing and heat sealing. Due to the strong connection described above in the front areas of the container 1, the edges extending at these points, namely the edges of the segment 5' for the lid 3, the segment for the bottom 4 and the segment 6' for the container body 2 which edges heretofore have lain bare, are well protected so that an additional edge protection is not necessary.

The edge 13 seen in FIG. 2 projected into the inside of the container body 2 has an edge protection which will be described below with reference to FIGS. 6 and 8. For the production of the ring-shaped wall 6 shown in FIG. 6, the segment 6' as shown in FIG. 8 is used. The segment 6' of FIG. 8 is provided before shaping with a first embodiment of a protective covering 24 which is also shown in FIG. 6 on the formed wall 6.

It can be seen from FIGS. 6 and 8 that the wall 6 of the container body 2 consists of a carrier layer 22, preferably of paper or cardboard, and a protective layer 23. The carrier layer 22 and the protective layer 23 comprise a plurality of material layers. The protective layer 23, which forms the inner surface 12 of the wall 6 serves to protect the container contents and can, for example, be an aluminum layer. In the outer surface 11 of the illustrated embodiment of FIG. 6, an additional protective layer is not provided. It is, of course, within the scope of the present invention that in other embodiments such an additional protective layer, for example for protecting the container 1 or the contents thereof from outside influences, could be applied to the outer surface 11 of the wall 6.

The edge 13 of the wall 6 projected into the inside of the container body 2 is provided with the above mentioned protective covering 24 which covers both the inner surface 12 and the outer surface 11 of the segment 6', formed into the wall 6, in the area 27. The segment 6' in the area 27 covered by the protective covering 24 has such a reduced thickness that the overall thickness, including the protective covering 24, of the segment 6' measures at least approximately the same as the thickness of the segment 6' in its other areas.

As can be seen from FIG. 8, a region 29 of the carrier layer 22 is compressed in the area 27 in which the segment 6', except for the covering 24 has a reduced thickness. The protective layer 23 does not have a reduced thickness in the area 27. This applies also to the flat areas 31 and 30 of the protective covering 24 adjacent to the surfaces 11, 12. In the embodiment shown in FIGS. 6 and 8, the reduced thickness in the area 27 of the segment 6' is attained only by compressing the carrier layer 22. In the embodiment in FIG. 8 and similar to the embodiment in FIG. 7, compression can also be carried out on only one side. The protective covering 24 also has a constant thickness as in the embodiment shown in FIGS. 6 and 8. In addition to the area 34 of the carrier layer 22, the area 35 of the protective layer 23 also has a reduced thickness.

Figure 9:
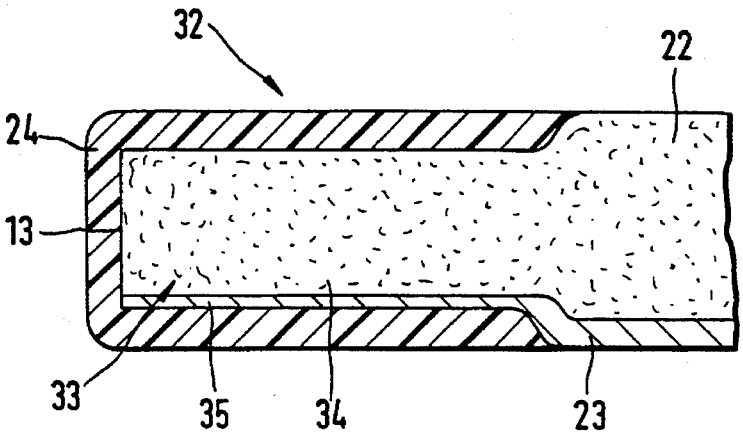
FIG. 9 is a partial cross-sectional view similar to FIG. 8 but of another embodiment of a segment for a container body.
Figure 10:
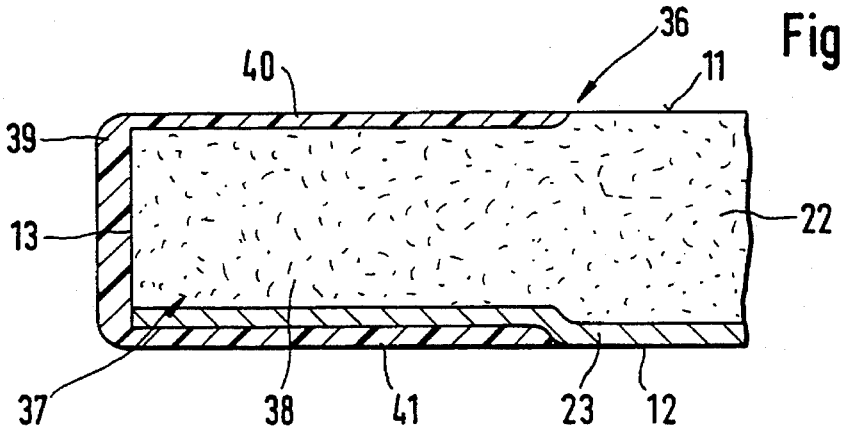
FIG. 10 is a partial cross-sectional view similar to FIG. 8 but of a further embodiment of a segment for a container body.
Figure 11:
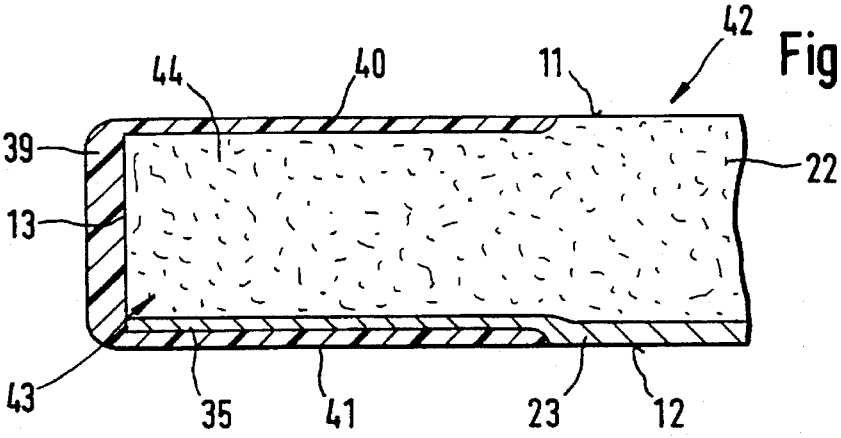
FIG. 11 is a partial cross-sectional view similar to FIG. 8 of still another embodiment of a segment for a container body.

In the embodiments shown in FIGS. 9 to 11, the protective covering 24, 39 is, as in the embodiment shown in FIGS. 6 and 8, formed by a separate component, which has the shape of a narrow strip. The protective covering 39 can, however, itself be additionally compressed, as shown in FIGS. 10 and 11.

In the embodiment shown in FIG. 9, the segment 32 has a reduced thickness in the area 33 containing the edge 13. The thickness of the area 33 in the embodiment in FIG. 9 corresponds to the thickness of the area 27 in FIGS. 6 and 8.

In the embodiment of FIG. 10, the segment 36 has an area 37 with a reduced thickness. The area 38 of the carrier layer 22 is thereby reduced in thickness. The protective layer 23 has a constant thickness also in the area 37 of the segment 36. The protective covering 39, in contrast, is less thick than in the embodiments already described. The protective covering 39 has such a reduced thickness in the areas 40, 41 adjacent to the respective surfaces 11, 12 of the segment 36 that the thickness of the segment 36 is constant overall.

In the embodiment of FIG. 11, the segment 42 has a reduced thickness in the area 43 which contains the edge 13. The area 44 of the carrier layer 22, the area 35 of the protective layer 23 and the areas 40, 41 of the protective covering 39 which border the surfaces 11, 12 all have reduced thickness. The reduction is such that the segment 42 has an overall constant thickness.

Figure 18:
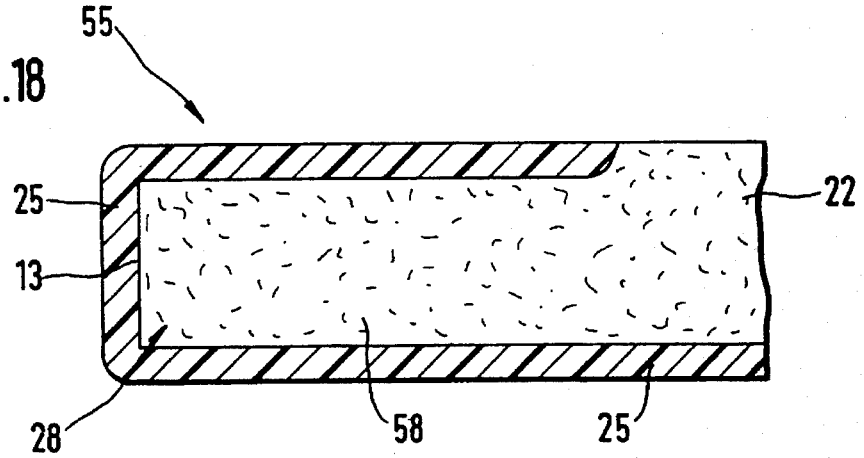
FIG. 18 is a partial cross-sectional view similar to FIG. 8 of another embodiment of the segment for a container body.

In the embodiment shown in FIGS. 7 and 18, the edge 13 is covered with a second embodiment of a protective covering 25. This protective covering 25 is made from the same piece of material as the protective layer which forms the inner surface 12 of the wall 6. An additional protective covering is therefore not present. The area 28 of the segment 55 which forms the wall 6 is reduced in thickness, so that a segment 55 with an overall constant thickness is produced. The reduced thickness of the area 28 of the segment 55 is made by compression of the area 58 of the carrier layer 22, the thickness of the carrier layer 22 being thereby reduced.

The protective covering 24, 25, 39 is already present in the case of the segments 6', 36, 42, 55 in all embodiments before the segments are formed into the wall 6 of the container body 2.

FIGS. 13 and 14 show the edge protection in the case of the opening 7 of the segment 5' for the wall 6 of the lid 3. The edge protection comprises a protective covering 45 which covers an edge 49 extending along the border of the opening 7 set in the segment 5'. The area 46 covered by the protective covering 45 is reduced in thickness.

The opening 7 provided with the protective covering 45 is closed, as already mentioned above, by a pull tab 8 secured with an adjacent part 47, preferably by heat sealing, onto the outer surface 9 of the segment 5'. In the area 50, in which the segment 5' is covered by the adjacent part 47 of the pull tab 8, the segment 5' is less thick.

The pull tab 8 has a pivotable part 48 which is shown in FIG. 13 in position 48' pulled away from the opening 7 and in FIG. 14 in a position closing the opening 7. In that area in which the pivotable part 48 comes to rest on the segment 5' after closing, the segment 5' has an area 51 with reduced thickness. It is often sufficient, however, to provide a reduced thickness wherever the protective covering 45 is located. In the areas 46, 50 and 51, the thickness of the segment 5' is reduced such that the segment 5' has an overall constant thickness even after the protective covering 45 and the pull tab 8 are applied, and also after the pull tab 8 is closed.

After the pull tab 8 has been pivoted into the position shown in FIG. 14, the inner surface of the pull-up part 48 is secured against the protective covering 45, preferably by heat sealing to provide a proof seal.

Figure 4:
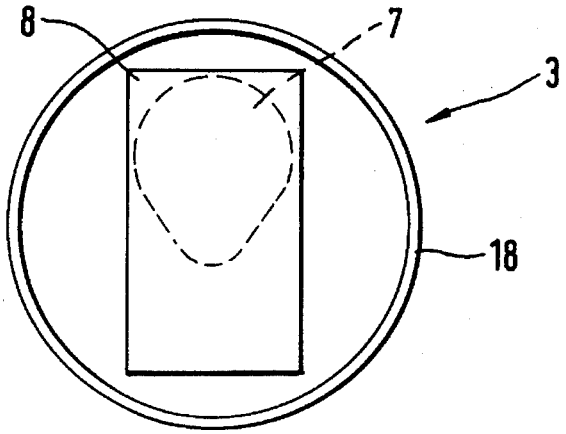
FIG. 4 is a top view of the lid of the container in FIG. 1.

The segment 5' is already formed before shaping to the lid 3 shown in FIG. 4 and, therefore, before the joining to the container 1 in the above-described manner. The pull tab 8 only then closes the opening 7, that is before the container 1 is joined together, when the opening 7 is not used for filling the container 1.

In the illustrated embodiment, the container 1 is filled only after the lid 3 has been attached to the container body 2. Filling takes place through the opening 7, which serves as a filling opening. Care is taken that the pull-up part 48 of the pull tab 8 does not cover the opening 7. The closing of the opening 7 by the pull tab 8 then takes place after the filling of the container 1. The pull tab 8 can be pulled open in order to empty the container 1. The opening 7 is simultaneously a pouring opening.

Figure 15:
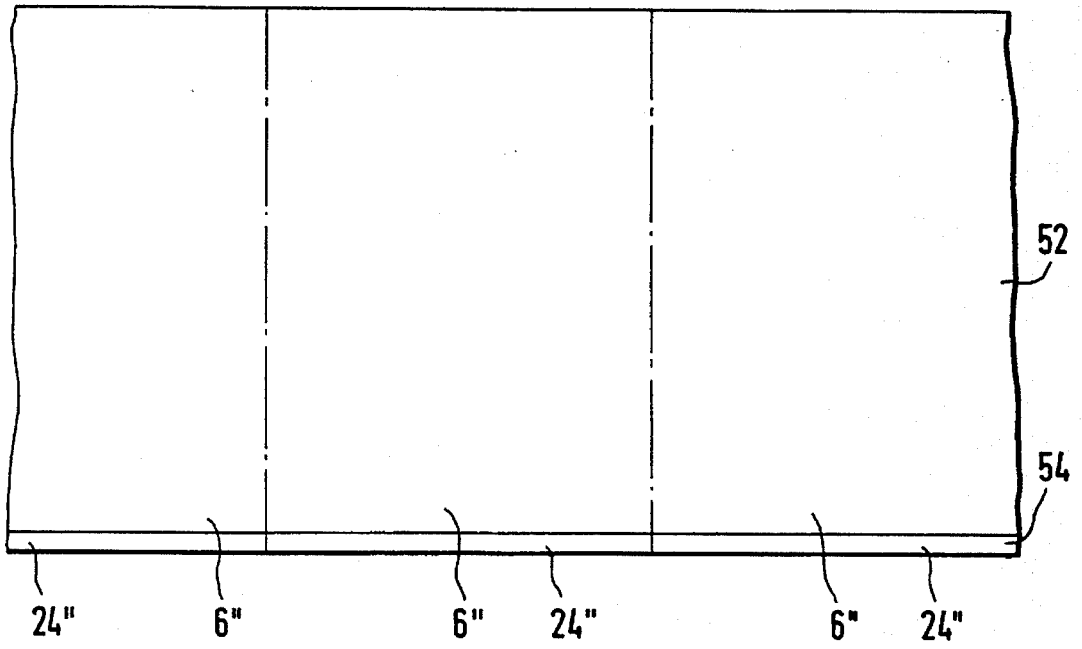
FIG. 15 is a reduced projection diagram into plan view of a cardboard tape with a plurality of segments from FIG. 5.
Figure 16:
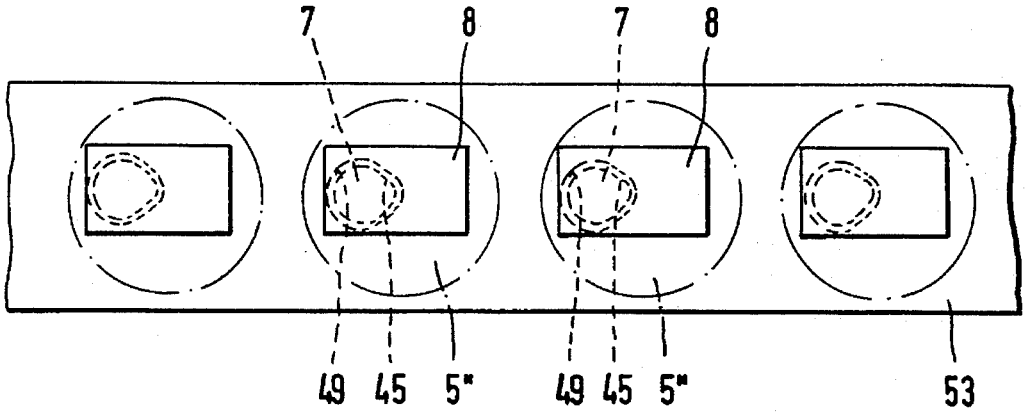
FIG. 16 is a reduced diagram of a cardboard tape with a plurality of segments from FIG. 12.

Due to the overall constant thickness of the segment 6' for the container body 2, the segment 5' for the lid 3 and the segment for the bottom 4, it is now possible to apply the segments 6', 6" and 5', 5" in the form of piles or cardboard tapes 52 and 53 as seen in FIGS. 15 and 16.

In FIG. 15, a plurality of rectangular segments 6" are attached together to form a cardboard tape 52. The cardboard tape 52 also has a constant thickness in the area of the covering tape 54. The cardboard tape 52 can, therefore, be presented as a roll to a machine for producing containers 1. The segments 6" can be detached from the cardboard tape 52 at the dot-dash lines, thus forming a separate, rectangular segment 6' seen in FIG. 5. A covering tape 54 is arranged at one longitudinal edge of the cardboard tape 52 and is made up of a plurality of non-separated protective coverings 24" attached together.

When the segments 6" are separated from the cardboard tape 52, a part of the covering tape 54 is separated therewith, and this separated part forms the protective covering 24' of the separated segment 6'. The edge protection for the container body 2, to be formed subsequently, is already provided on the cardboard tape 52 as the covering tape 54, so that a procedure for applying an edge protection in the case of a container making machine is unnecessary.

In FIG. 16, a cardboard tape 53 is shown which comprises a plurality of segments 5" for the lid 3. Each segment 5" is already provided with an opening 7, whereby the edges 49 are covered by a protective covering 45. A pull tab 8 is attached to each segment 5", which pull tab takes up the closed position as shown in FIG. 14. The pull tab 8 is, however, not fixed securely to the protective covering 45, so that it can be pulled up from the opening 7 for filling. The cardboard tape 53 with the segments 5" has an overall constant thickness, even in the area of the protective coverings 45 and the pull tabs 8. It is, therefore, possible to present the cardboard tape 53 in the form of a roll to a machine for producing containers 1. Here a procedure for applying an edge protection in the case of a container producing machine also unnecessary.

The reduction of the thickness takes place, for example, by mechanical compression with a suitable tool or implement. It is thus possible to carry out the compression of the areas 27, 28, 33, 37, 43, 46 to be covered by the respective protective covering 24, 25, 39, 45 before, during or after application of the protective covering 24, 25, 39, 45. This also applies to the areas 50, 51 to be covered by the pull tab 8. These areas 50, 51 can, of course, also be compressed before, during or after the application of the pull tab 8.

Material which is preferably heat sealable, for example polyethylene, is used for the protective covering 24, 25, 39, 45. This material allows the protective covering 24, 25, 39, 45 to be attached to the respective segment 5', 6', 32, 36, 42, 55. It is, in addition, possible to attach the overlapping portions 15, 56 together during production of the container body 2, and during application or closing of the pull tab 8, to connect the part 47 with the outer surface 9 of the segment 5' or the pivotable portion 48 with the protective covering 45.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A container comprising at least one wall element formed from at least one sheet-shaped segment having a defined thickness and at least one edge enclosed by a U-shaped protective covering over an inner surface and an outer surface at least along a region bordering the at least one edge and having a thickness smaller than the defined thickness, wherein, prior to formation of the container by configuring the segment into a desired shape, said region is provided with the thickness smaller than the defined thickness and resulting from compression such that the segment, including the region having the protective covering has an approximately constant thickness along a full extent of the segment including the at least one edge covered by the protective coating, with inner and outer surfaces of the protective covering being flush with inner and outer surfaces of the segment adjacent the protective covering.

2. The container according to claim 1, wherein the segment comprises a carrier layer and a protective layer, and the carrier layer is compressed to a reduced thickness in the region covered by the protective covering.

3. The container according to claim 1, wherein the protective covering at the area of the covered segment is a compressed covering.

4. The container according to claim 3, wherein at least a portion of the protective covering has a compression-reduced thickness.

5. The container according to claim 2, wherein the carrier layer is made of one of paper and cardboard.

6. The container according to claim 2, wherein the protective covering constitutes a portion of material of the protective layer of the segment.

7. The container according to claim 1, wherein the segment is a first segment formed into a wall element constituting a container body element, and a second segment is formed into a wall element which forms a lid of the container.

8. The container according to claim 7, wherein each segment comprises a carrier layer and a protective layer, and the carrier layer of each segment is configured to have a compression-produced reduced thickness in a region covered by the protective layer.

9. The container according to claim 8, wherein the protective layer of each segment has a compression-produced reduced thickness in a region covered by the protective covering.

10. The container according to claim 7, wherein the first segment formed into the wall element of the container has overlapping end portions which rest against each other, the at least one edge being directed towards one of an inside direction and an outside direction of the container and being covered with the protective covering.

11. The container according to claim 10, wherein the first segment formed into the wall element of the container body element has a section containing the covered edge which overlaps the inner surface of the wall element and is secured thereagainst.

12. The container according to claim 1, wherein the at least one wall element has an opening.

13. The container according to claim 12, wherein an area of the opening is coverable by a pull tab securable to an outer surface of the at least one wall element.

14. The container according to claim 13, wherein the area of the opening coverable by the pull tab has a reduced thickness such that the segment, the pull tab and the associated protective covering have an overall approximately constant thickness.

15. The container according to claim 14, wherein the reduced thickness of the segment is a compression-produced configuration.

16. The container according to claim 15, wherein the segment comprises a carrier layer and a protective layer, and the carrier layer is compressed to the thickness smaller than the defined thickness, and at least one of the region, the carrier layer in the region, the protective layer in the region and the protective covering in the region is a mechanical pressure-produced configuration.

17. A container comprising at least one wall element made of at least one sheet-shaped segment having at least one edge enclosed by a protective covering covering an inner surface and an outer surface at least at a region bordering the at least one edge, wherein said region is provided with a reduced thickness resulting from compression such that the segment including the region having the protective covering has an overall, approximately constant thickness, wherein the segment comprises a carrier layer and a protective layer, and the carrier layer is compressed to a reduced thickness in the region having the protective covering, and the protective layer of the segment has a compression-produced reduced thickness in the region covered by the protective covering.

18. A container comprising at least one wall element made of at least one sheet-shaped segment having at least one edge enclosed by a protective covering covering an inner surface and an outer surface at least at a region bordering the at least one edge, wherein said region is provided with a reduced thickness resulting from compression such that the segment including the region having the protective covering has an overall, approximately constant thickness, wherein the segment comprises a carrier layer and a protective layer, and the carrier layer is compressed to a reduced thickness in the region having the protective covering, and the carrier layer is made of one of paper and cardboard, and the protective layer has a compression-produced reduced thickness in the region covered by the protective covering.

19. A container comprising at least one wall element made of at least one sheet-shaped segment having at least one edge enclosed by a protective covering covering an inner surface and an outer surface at least at a region bordering the at least one edge, wherein said region is provided with a reduced thickness resulting from compression such that the segment including the region having the protective covering has an overall, approximately constant thickness, wherein the segment comprises a carrier layer and a protective layer, and the carrier layer is compressed to a reduced thickness in the region having the protective covering, and the protective covering constitutes a portion of material of the protective layer of the segment, and the protective layer of the segment has a compression-produced reduced thickness in the region covered by the protective covering.

20. The container according to claim 19, wherein the carrier layer is made of one of paper and cardboard.

21. A container comprising at least one wall element made of at least one sheet-shaped segment having at least one edge enclosed by a protective covering covering an inner surface and an outer surface at least at a region bordering the at least one edge, wherein said region is provided with a reduced thickness resulting from compression such that the segment including the region having the protective covering has an overall, approximately constant thickness, wherein the segment is formed into a wall element of the container such that sections of end portions thereof overlap and rest against each other, the at least one edge is directed towards one of an inside direction and an outside direction of the container, and the at least one edge is covered with the protective covering.

* * * * *